US006257096B1

(12) United States Patent
Ling

(10) Patent No.: US 6,257,096 B1
(45) Date of Patent: Jul. 10, 2001

(54) SOCKET ADAPTOR FOR RATCHET

(76) Inventor: David Ling, P.O. Box 63-247, Taichung (TW)

( * ) Notice: Subject to any disclaimer, the term of this patent is extended or adjusted under 35 U.S.C. 154(b) by 0 days.

(21) Appl. No.: 09/699,090

(22) Filed: Oct. 30, 2000

Related U.S. Application Data

(63) Continuation-in-part of application No. 09/291,751, filed on Apr. 14, 1999, now abandoned, which is a continuation-in-part of application No. 09/015,925, filed on Jan. 30, 1998, now abandoned.

(51) Int. Cl.[7] ..... B25B 13/46
(52) U.S. Cl. ..... 81/60; 81/61; 81/177.85
(58) Field of Search ..... 81/60, 61, 177.85, 81/63.2, 177.1, 177.2, 180.1

(56) References Cited

U.S. PATENT DOCUMENTS 4,328,720 * 5/1982 Shiel ..... 81/63
4,420,995 * 12/1983 Roberts ..... 81/60
5,509,333 * 4/1996 Rion ..... 81/177.85
5,595,095 * 1/1997 Hillinger ..... 81/60
6,006,631 * 12/1999 Miner et al. ..... 81/177.85

* cited by examiner

*Primary Examiner*—James G. Smith
*Assistant Examiner*—Hadi Shakeri
(74) *Attorney, Agent, or Firm*—Charles E. Baxley

(57) ABSTRACT

A socket adaptor is mounted to a box end of a ratchet-type ring spanner of the type having a hollow ratchet wheel rotatably mounted in the box end. The socket adaptor includes a disc, a mediate section projected from the disc and releasably engaged with the hollow ratchet wheel mounted in the box end of the wrench, and a distal socket engaging portion beyond the hollow ratchet wheel. The mediate section of the socket adaptor has an outer periphery for releasably engaging with an inner periphery of the hollow ratchet wheel to rotate therewith. The distal socket engaging portion is to be releasably engaged with a socket.

8 Claims, 4 Drawing Sheets

SOCKET ADAPTOR FOR RATCHET

CROSS REFERENCE TO RELATED APPLICATION

This is a continuation-in-part application of U.S. patent application Ser. No. 09/291,751 filed on Apr. 14, 1999, abandoned, which, in turn, is a continuation-in-part application of U.S. patent application Ser. No. 09/015,925 filed on Jan. 30, 1998, abandoned.

BACKGROUND OF THE INVENTION

1. Field of the Invention

The present invention relates to a socket adaptor for ratchet-type ring spanners and, more particularly, to a socket adaptor which may be mounted into a box end of a ratchet-type ring spanner such that the ratchet-type ring spanner can be used as a socket wrench.

2. Description of the Related Art

A wide variety of wrenches have been developed, e.g., spanners, Allen wrenches, adjustable spanners, socket wrenches, combination wrenches, etc. A typical socket wrench comprises a handle having switch button mounted to a front end thereof. In use, the user has to grasp the handle with one hand and use the other hand to switch the switch button for changing the rotating direction. Nevertheless, the socket wrenches usually have a relatively large head portion which causes inconvenience when working in a relatively small space. A solution to the above problem is to use ring spanners. Ratchet-type ring spanners have been developed and includes a ratchet wheel rotatably mounted in a box end of the ring spanner. A pawl mounted in a web area of the handle of the spanner is biased by a spring to engage with the ratchet wheel such that the ratchet wheel rotates freely when the handle rotates in a direction and that the ratchet wheel drives a bolt head or nut when the handle rotates in a reverse direction. Nevertheless, ring spanners, whether of ratchet-type or not, can only fit an object (e.g., bolts, nuts) of a particular size. More specifically, the user has to frequently change the ring spanners when bolts and nuts of different sizes are involved.

The present invention is intended to provide a socket adaptor which mitigates and/or obviates the above problems.

SUMMARY OF THE INVENTION

It is an object of the present invention to provide a socket adaptor which may be mounted to a ratchet-type ring spanner such that the ring spanner can be used as a socket wrench.

A socket adaptor in accordance with the present invention can be mounted into a hollow ratchet wheel in a box end of a ring spanner. The socket adaptor includes a disc, a mediate section projected from the disc and releasably engaged with the hollow ratchet wheel mounted in the box end of the ring spanner, and a distal socket engaging portion beyond the hollow ratchet wheel. The mediate section of the socket adaptor has an outer periphery for releasably engaging with an inner periphery of the hollow ratchet wheel to rotate therewith. The distal socket engaging portion is to be releasably engaged with a socket.

The mediate section includes two polygonal members with an annular recess defined therebetween, and a plastic O-ring is received in the annular recess and in contact with the hollow ratchet wheel for retaining the mediate section of the socket adaptor in the hollow ratchet wheel.

In a preferred embodiment of the invention, the mediate section of the socket adaptor includes a compartment, and the distal socket engaging portion of the socket adaptor includes a longitudinal bore communicated with the compartment. The distal socket engaging portion further includes a transverse hole and communicated with the longitudinal bore. A ball is partially received in the transverse hole. A pin has a shank extended through the longitudinal bore of the distal socket engaging portion of the socket adaptor. The pin further includes a head received in the compartment of the mediate section. The shank of the pin includes a recess defined therein for receiving a portion of the ball.

Accordingly, the ring spanner with the socket adaptor of the present invention may be used in a relatively small space and may be operated with a number of sockets without troublesome changing of the whole combination wrench.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
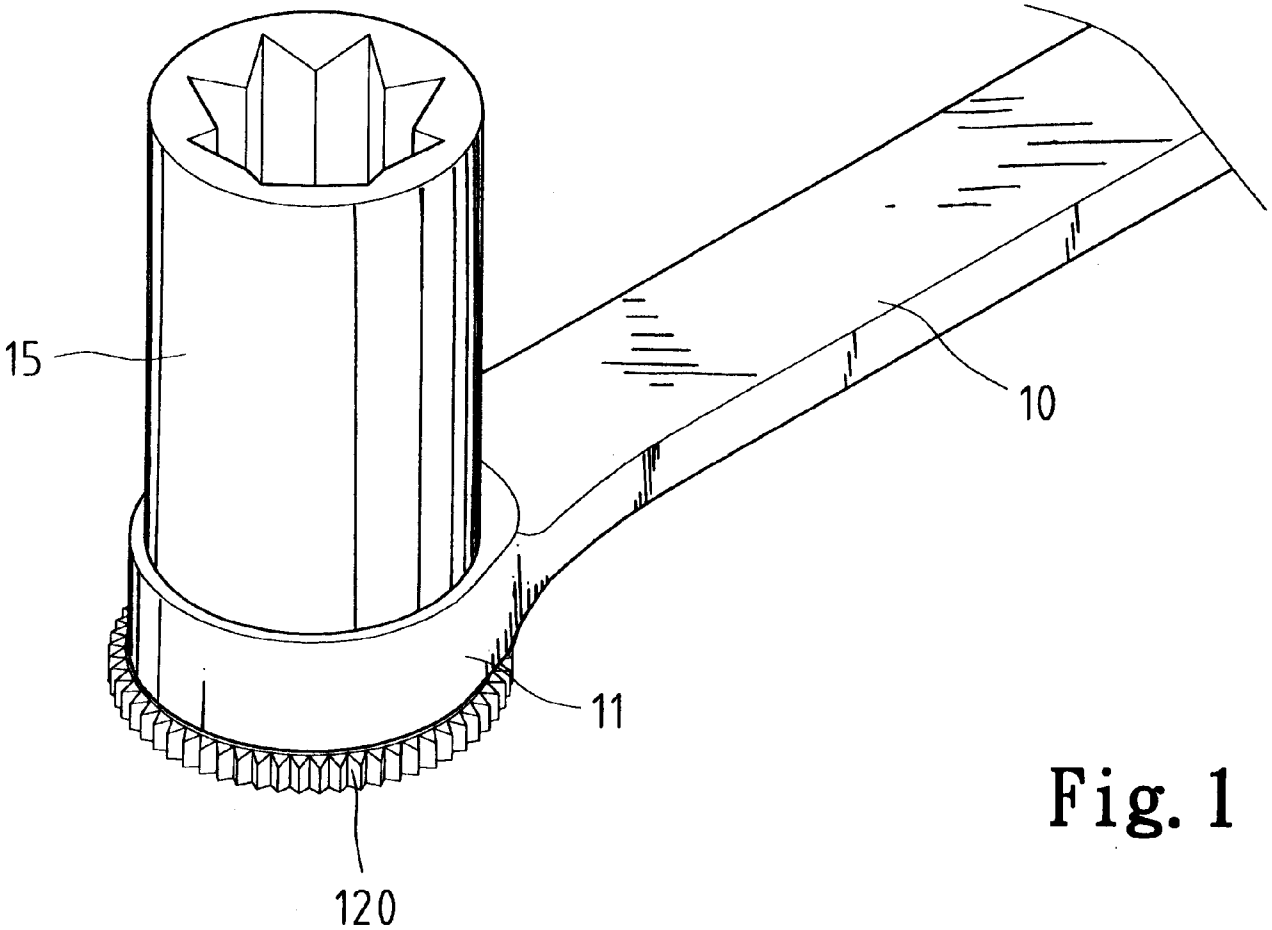
FIG. 1 is a perspective view of a ratchet-type ring spanner with a socket adaptor in accordance with the present invention.
Figure 2:
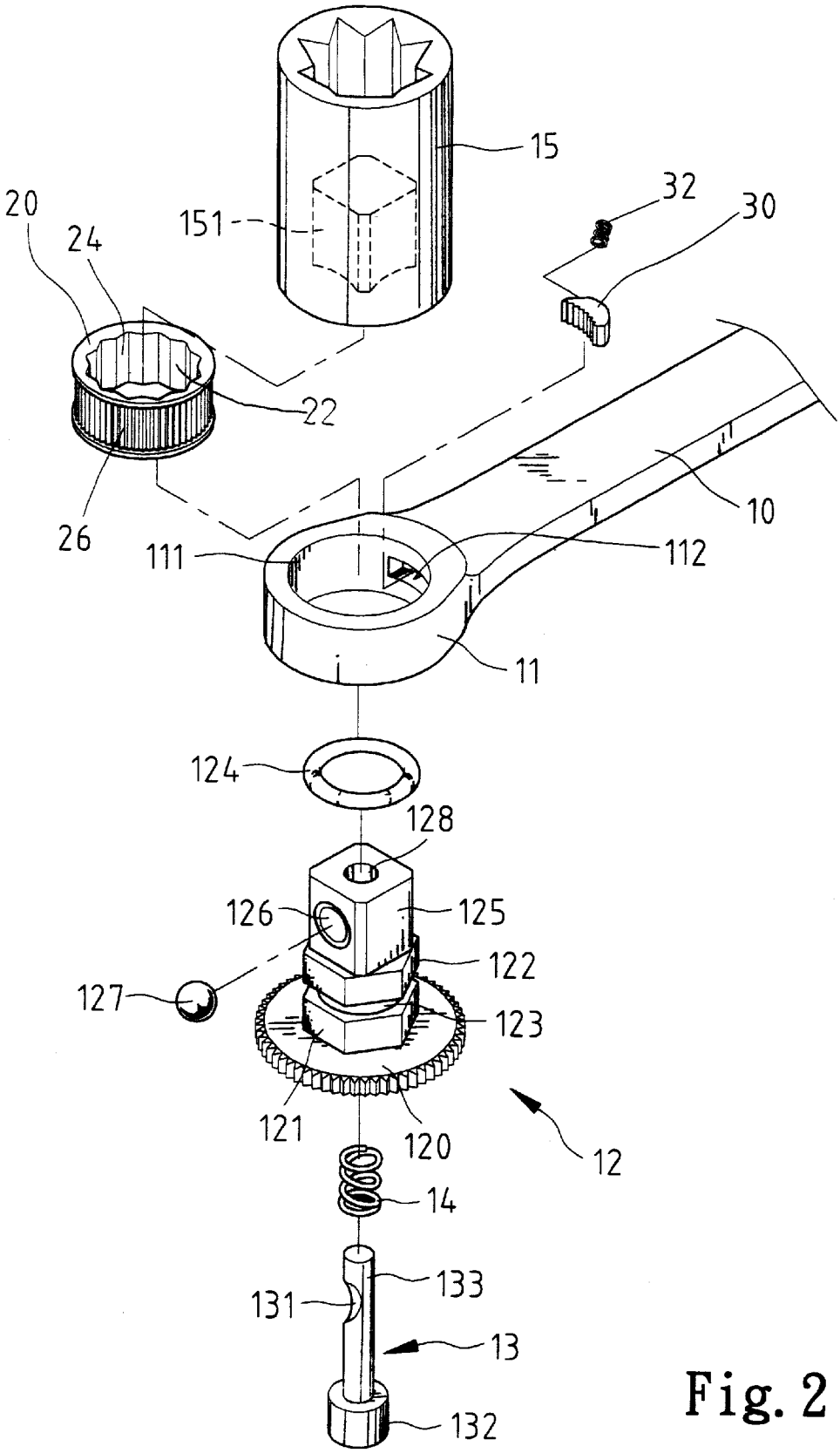
FIG. 2 is an exploded perspective view of the ring spanner in FIG. 1.
Figure 3:
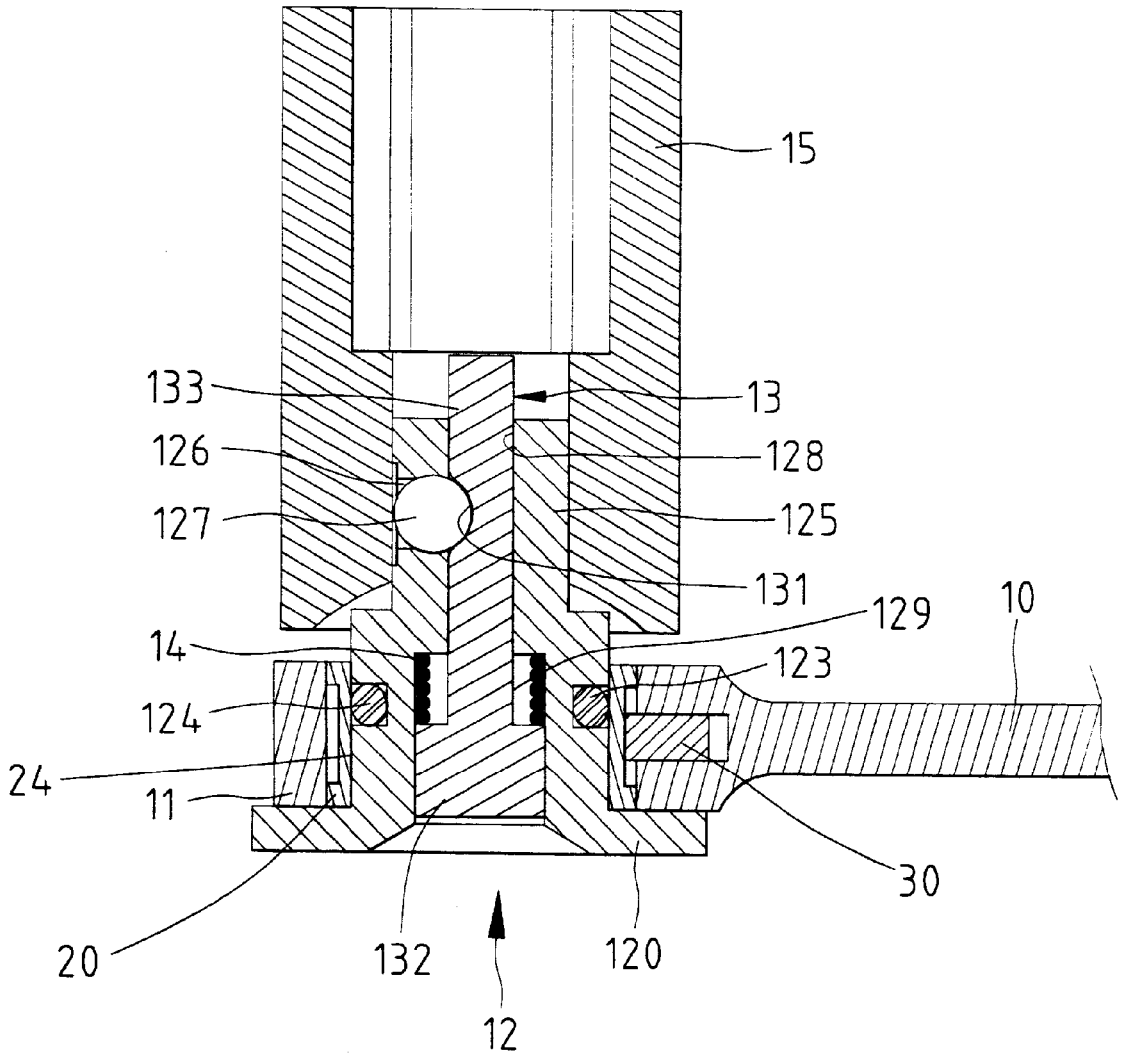
FIG. 3 is a longitudinal sectional view of the ring spanner in FIG. 1.
Figure 4:
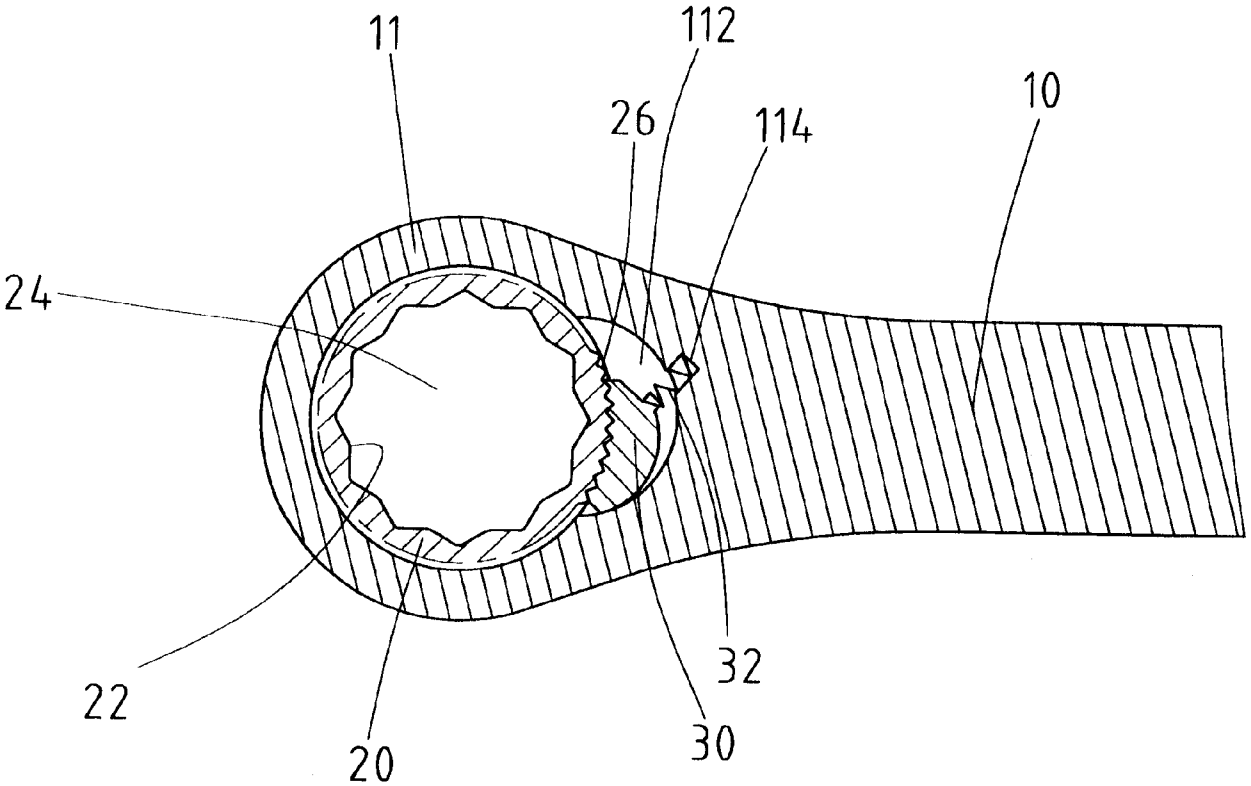
PRIOR ART Fig. 4
FIG. 4 is a sectional view of a conventional ratchet-type ring spanner.

Referring to FIG. 4, a typical ratchet-type ring spanner generally comprises a handle 10 having two box ends 11 (only one is shown). A ratchet wheel 20 is rotatably mounted in a first compartment 111 (FIG. 2) defined in each box end 11. A second compartment 112 is defined in a web area of the handle 10 and includes a pawl 30 mounted therein. A cavity 114 is defined in a wall defining the second compartment 112 for receiving an end of a spring 32 that biases the pawl 30 to engage with ratchet teeth 26 in an outer periphery of the ratchet wheel 20. The ratchet wheel 20 further includes an inner periphery 22 defining a space 24 therein for engaging with a bolt head or nut to be tightened or loosened. The ratchet wheel 20 rotates freely when the handle 20 rotates in a direction and that the ratchet wheel 20 drives a bolt head or nut when the handle 10 rotates in a reverse direction. Operation of such a conventional ratchet wheel will not be further described, as it is irrelevant to the feature of the invention. Referring to FIGS. 1 to 3, a socket adaptor in accordance with the present invention includes a disc 120, a mediate section projected from the disc 120, and a distal socket engaging portion 125. In this embodiment, the mediate section includes two polygonal (e.g., hexagonal) members 121 and 122 for releasably engaging with the inner periphery 22 of the ratchet wheel 20. Thus, the ratchet wheel 20 is driven to rotate when the socket engaging portion 125 is engaged with a socket 15 and the handle 10 is rotated. The socket engaging portion 125 includes a transverse hole 126 defined in a side thereof for partially receiving a ball 127. In addition, a plastic O-ring 124 (e.g., made of rubber) may be received in an annular groove 123 defined between the polygonal members 121 and 122. The O-ring 124 provides a secure retaining effect between the mediate section of the socket adaptor 12 and the inner periphery 22 of the ratchet wheel 20 in the box end 11. Thus, the socket adaptor 12 is securely (yet releasably) engaged with the ratchet wheel 20 to rotate therewith.

As shown in FIG. 3, the mediate section includes a compartment 129 (FIG. 3) defined therein, and the socket engaging portion 125 includes a longitudinal bore 128 communicated with the compartment 129 of the mediate section and the transverse hole 126. A pin 13 includes a shank 133 extended through the bore 128 and a head 132 received in the compartment 129 of the mediate portion. The shank 133 includes a recess 131 defined therein for receiving a portion of a ball 127 partially received in the transverse hole 126, best shown in FIG. 3. A spring 14 may be mounted around the shank 133 of the pin 13 and received in the compartment 129 of the mediate section.

The socket engaging portion 125 may releasably engage with an engaging hole 151 of a socket 15. In use, the socket engaging portion 125 may engage with a number of sockets 15 of different sizes. Accordingly, the ring spanner with the socket adaptor of the present invention may be used in a relatively small space and may be operated with a number of sockets without troublesome changing of the whole ring spanner.

Although the invention has been explained in relation to its preferred embodiment, it is to be understood that many other possible modifications and variations can be made without departing from the spirit and scope of the invention as hereinafter claimed.

What is claimed is:

1. A ratchet-type ring spanner comprising:

a handle having a box end, a hollow ratchet wheel being rotatably mounted in the box end; and a socket adaptor comprising a disc, a mediate section projected from the disc and releasably engaged with the hollow ratchet wheel, and a distal socket engaging portion beyond the hollow ratchet wheel, the mediate section of the socket adaptor having an outer periphery for engaging with an inner periphery of the hollow ratchet wheel to rotate therewith, the distal socket engaging portion being adapted to be releasably engaged with a socket.

2. The ratchet-type ring spanner according to claim 1, the mediate section includes an annular recess defined in the outer periphery thereof, and a plastic O-ring is received in the annular recess and in contact with the inner periphery of the hollow ratchet wheel for retaining the mediate section of the socket adaptor in the hollow ratchet wheel.

3. The ratchet-type ring spanner according to claim 1, wherein the mediate section includes two polygonal members with an annular recess defined therebetween, and a plastic O-ring is received in the annular recess and in contact with the inner periphery of the hollow ratchet wheel for retaining the mediate section of the socket adaptor in the hollow ratchet wheel.

4. The ratchet-type ring spanner according to claim 1, wherein the mediate section includes a compartment, and wherein the distal socket engaging portion of the socket adaptor includes a longitudinal bore communicated with the compartment, the distal socket engaging portion further including a transverse hole and communicated with the longitudinal bore, a ball being partially received in the transverse hole, and further comprising a pin having a shank extended through the longitudinal bore of the distal socket engaging portion of the socket adaptor, the pin further including a head received in the compartment of the mediate section, the shank of the pin including a recess defined therein for receiving a portion of the ball.

5. A socket adaptor adapted to be mounted to a box end of a ratchet-type ring spanner of a type having a hollow ratchet wheel rotatably mounted in the box end, the socket adaptor comprising:

a disc, a mediate section projected from the disc and releasably engaged with the hollow ratchet wheel, and a distal socket engaging portion beyond the hollow ratchet wheel, the mediate section of the socket adaptor having an outer periphery for releasably engaging with an inner periphery of the hollow ratchet wheel to rotate therewith, the distal socket engaging portion being adapted to be releasably engaged with a socket.

6. The socket adaptor according to claim 5, wherein the mediate section includes an annular recess defined in the outer periphery thereof, and a plastic O-ring is received in the annular recess and in contact with the inner periphery of the hollow ratchet wheel for retaining the mediate section of the socket adaptor in the hollow ratchet wheel.

7. The socket adaptor according to claim 5, wherein the mediate section includes two polygonal members with an annular recess defined therebetween, and a plastic O-ring is received in the annular recess and in contact with the inner periphery of the hollow ratchet wheel for retaining the mediate section of the socket adaptor in the hollow ratchet wheel.

8. The socket adaptor according to claim 5, wherein the mediate section includes a compartment, and wherein the distal socket engaging portion of the socket adaptor includes a longitudinal bore communicated with the compartment, the distal socket engaging portion further including a transverse hole and communicated with the longitudinal bore, a ball being partially received in the transverse hole, and further comprising a pin having a shank extended through the longitudinal bore of the distal socket engaging portion of the socket adaptor, the pin further including a head received in the compartment of the mediate section, the shank of the pin including a recess defined therein for receiving a portion of the ball.

* * * * *